US012427357B2

(12) United States Patent
Meredith

(10) Patent No.: US 12,427,357 B2
(45) Date of Patent: Sep. 30, 2025

(54) ADD ON WEIGHT SYSTEM FOR AN EXERCISE MACHINE

(71) Applicant: HOIST FITNESS SYSTEMS, INC., Poway, CA (US)

(72) Inventor: Jeffrey O. Meredith, Del Mar, CA (US)

(73) Assignee: HOIST FITNESS SYSTEMS, INC., Poway, CA (US)

( * ) Notice: Subject to any disclaimer, the term of this patent is extended or adjusted under 35 U.S.C. 154(b) by 107 days.

(21) Appl. No.: 18/421,351

(22) Filed: Jan. 24, 2024

(65) Prior Publication Data

US 2024/0269503 A1 Aug. 15, 2024

Related U.S. Application Data

(60) Provisional application No. 63/445,930, filed on Feb. 15, 2023.

(51) Int. Cl.
*A63B 21/062* (2006.01)

(52) U.S. Cl.
CPC ..... *A63B 21/063* (2015.10)

(58) Field of Classification Search
CPC ..... A63B 21/063; A63B 21/0628; A63B 21/00065; A63B 21/062; A63B 21/0626; A63B 21/0632
See application file for complete search history.

(56) References Cited

U.S. PATENT DOCUMENTS

| | | | | |
|---|---|---|---|---|
| 4,691,916 | A | 9/1987 | Voris | |
| 6,468,189 | B2 | 10/2002 | Alessandri | |
| 7,252,627 | B2 | 8/2007 | Carter | |
| 7,591,770 | B2 | 9/2009 | Stewart et al. | |
| 9,604,090 | B1 | 3/2017 | Meyer et al. | |
| 9,999,796 | B2 * | 6/2018 | Leipheimer | A63B 21/00065 |
| 12,311,220 | B2 * | 5/2025 | Fink | A63B 21/152 |
| 2016/0074688 | A1 | 3/2016 | Leipheimer | |
| 2016/0144216 | A1 | 5/2016 | Carter | |

FOREIGN PATENT DOCUMENTS

| | | | |
|---|---|---|---|
| SU | 1347948 | A1 | 10/1987 |

OTHER PUBLICATIONS

United States International Searching Authority, International Search Report and Written Opinion for corresponding International Application No. PCT/US2024/012751, mailed May 6, 2024, 8 pages.

* cited by examiner

*Primary Examiner* — Loan B Jimenez
*Assistant Examiner* — Kathleen M Fisk
(74) *Attorney, Agent, or Firm* — David R. Heckadon; Gordon Rees Scully Mansukhani ILP

(57) ABSTRACT

An add-on weight selection system for an exercise machine having an add-on weight panel configured to be lifted together with a selected number of stacked weight plates; and an add-on weight selection mechanism for moving the add-on weight panel between: an engaged position such that the add-on weight panel engages with the weight plates to be lifted and is lifted together with the selected weight plates, and a disengaged position such that the add-on weight panel disengages with the weight plates to be lifted and is not lifted together with the selected weight plates.

12 Claims, 10 Drawing Sheets

ADD ON WEIGHT SYSTEM FOR AN EXERCISE MACHINE

RELATED APPLICATION

The present application claims priority to U.S. Provisional Patent Application Ser. No. 63/445,930, of same title, filed Feb. 15, 2023, the entire disclosure of which in incorporated herein by reference in its entirety for all purposes.

TECHNICAL FIELD

The present weight selection system relates in general to exercise machines having stacked weight plates, and more particularly to mechanisms for selecting the exact amount of weight that the user wishes to lift.

BACKGROUND OF THE INVENTION

A common problem with users of weight stack exercise machines is that the user may want to add an intermediate weight (i.e.: a weight less than the weight of each of the plates in the weight stack) to add to the total weight that they are lifting. This is a common problem when users want to add weight in smaller increments to their exercise routines. For example, each plate in a weight stack may weigh 10 lbs and the user may instead wish to increase their exercise routines in 5 lb increments.

Solutions do exist to this problem in the form of smaller amounts of weight that can be selectively added to the plates of the weight stack as desired. Unfortunately, many of these solutions tend to be either bulky or counterintuitive to use. What is therefore instead desired is an easy to use system for adding an intermediate weight to a selected stack of weight plates. Ideally, such a system would be easy to use and permit the user to add the additional (i.e.: intermediate) weight to the stack with the simple flip of a switch. Ideally as well, such a system would preferably require minimal space to house and operate. As will be shown, the present system provides such a solution.

SUMMARY OF THE INVENTION

In preferred aspects, the present system provides an easy to use system for adding an incremental weight to the plates being lifted in a weight stack.

In one aspect, the present system provides an add-on weight selection system for an exercise machine, comprising:

(a) a weight stack comprising a plurality of stacked weight plates;

(b) a weight selector for selecting a number of the plurality of stacked weight plates to be lifted;

(c) an add-on weight panel configured to be lifted together with a selected number of the plurality of stacked weight plates; and (d) an add-on weight selection mechanism for moving the add-on weight panel between:

an engaged position such that the add-on weight panel engages with the weight plates to be lifted and is lifted together with the selected weight plates, and a disengaged position such that the add-on weight panel disengages with the weight plates to be lifted and is not lifted together with the selected weight plates.

In preferred aspects, the add-on weight selection mechanism comprises a vertical pole with a plurality of attached rollers. The rollers are positioned to travel along the vertical pole as the add-on weight panel is raised and lowered. In operation, the add-on weight selection mechanism rotates the add-on weight panel about a vertical axis (preferably passing through the vertical pole) between the engaged position and the disengaged position. The weight stack preferably includes a projection extending from a weight plate at the top of the weight stack, and the add-on weight panel has a notch dimensioned to receive the projection therein. As such, when the add-on weight panel is rotated into its engaged position, then the projection at the top of the weight stack moves into the notch in the panel, essentially hooking the panel onto the projection such that when the weight stack is lifted, the add-on panel will be lifted together with it.

In preferred aspects, the mechanism for moving the add-on weight panel about the vertical axis comprises a hand lever connected to the vertical pole, and the hand lever is optionally biased into the engaged position or the disengaged position.

In preferred aspects, the add-on weight panel is thin and positioned to hang behind the weight stack taking up little room as it moves up and down together with the weights in the weight stack when engaged.

One advantage of the present system is that it is very easy for a user to operate. The user merely has to flip the switch near the top of the vertical pole and the additional incremental weight is added to the weight stack for lifting. Preferably, the weight being added by the user's flip of the switch is less than the weight of each of the plates in the weight stack. For example, if each plate weighs 10 lbs, the additional weight being added by the present system can be 5 lbs. As such, the user can add weight in 5 lb increments (rather than 10 lb increments) by using the present system.

DETAILED DESCRIPTION OF THE FIGURES

Figure 1:
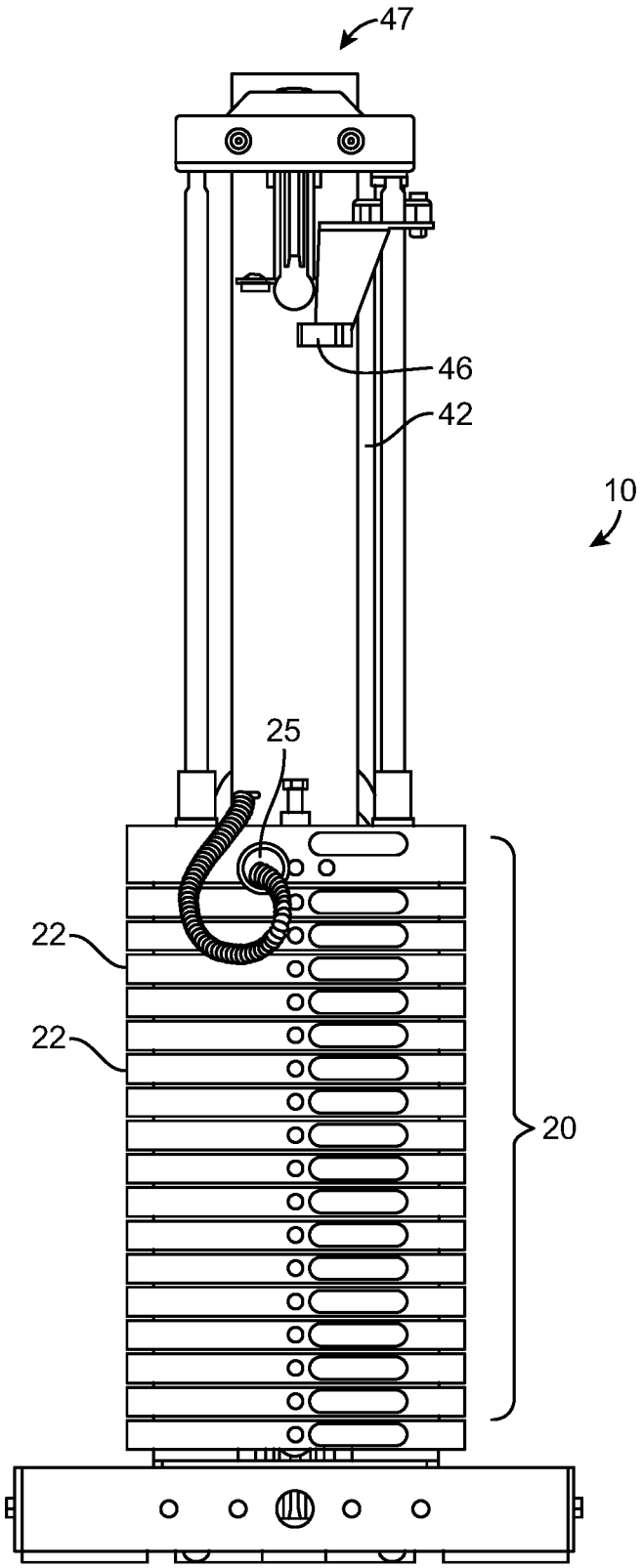
FIG. 1 is a front elevation view of the present system.
Figure 2:
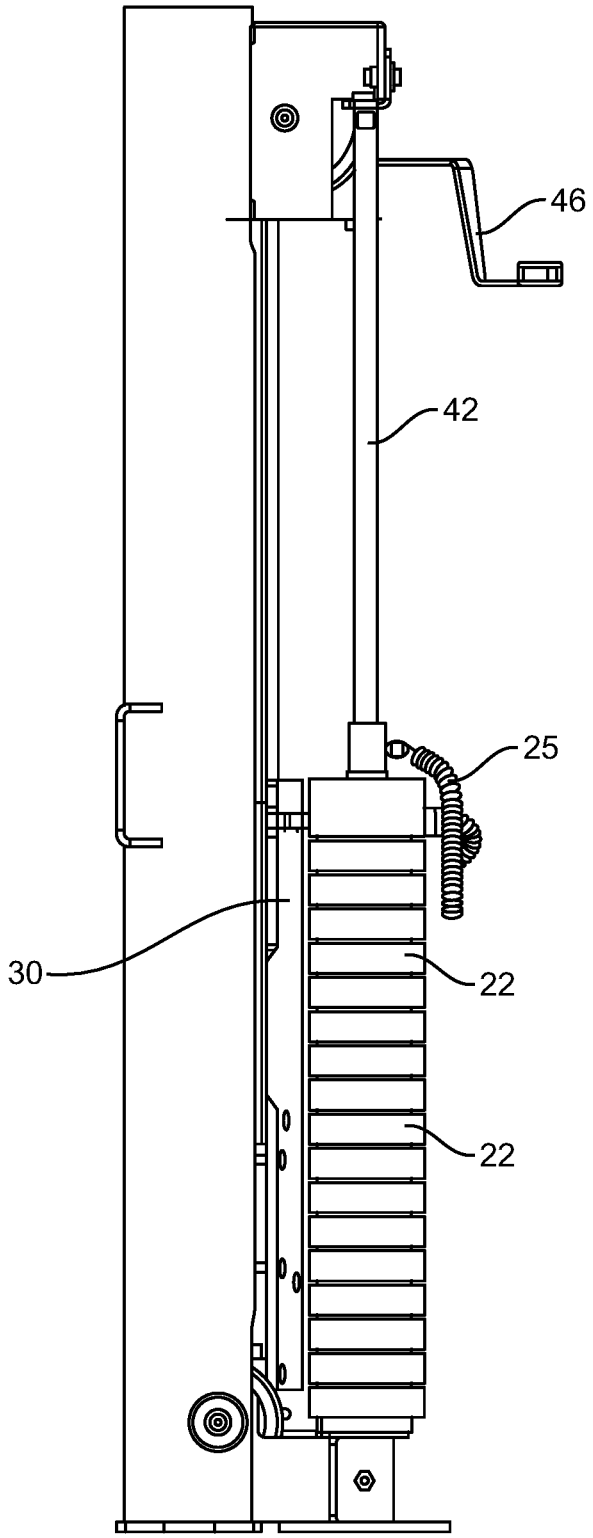
FIG. 2 is a left side elevation view of the present system.
Figure 3:
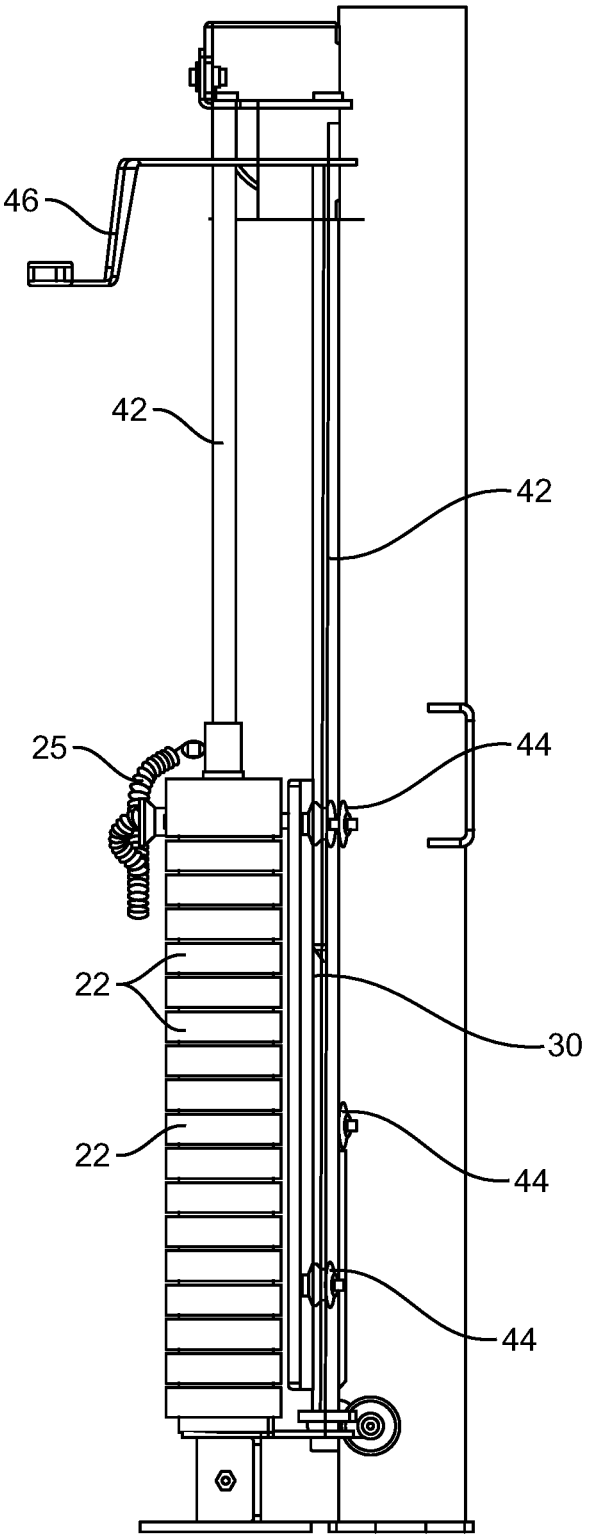
FIG. 3 is a right side elevation view of the present system.
Figure 4:
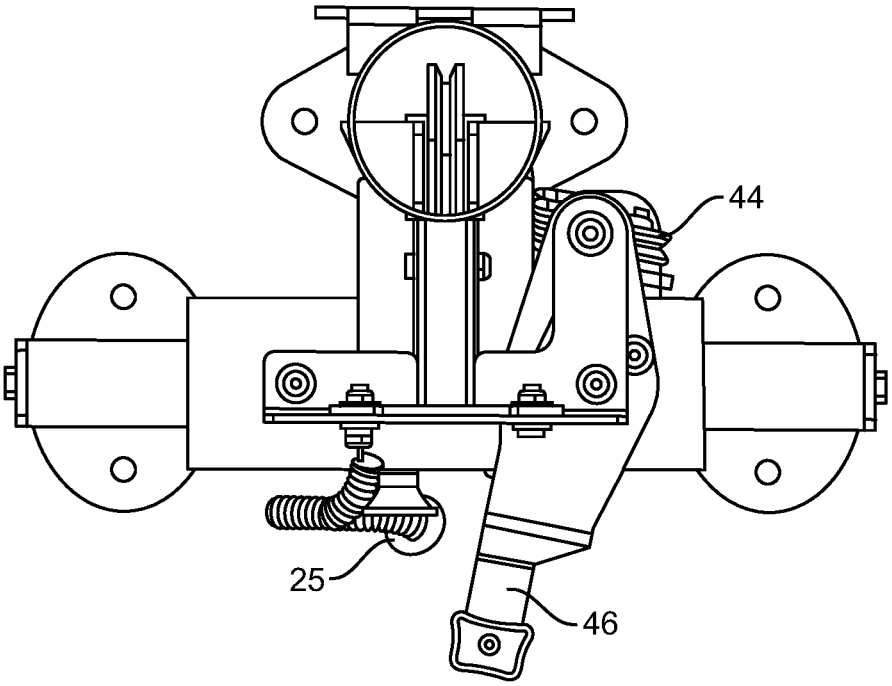
FIG. 4 is top plan view of the present system.
Figure 5:
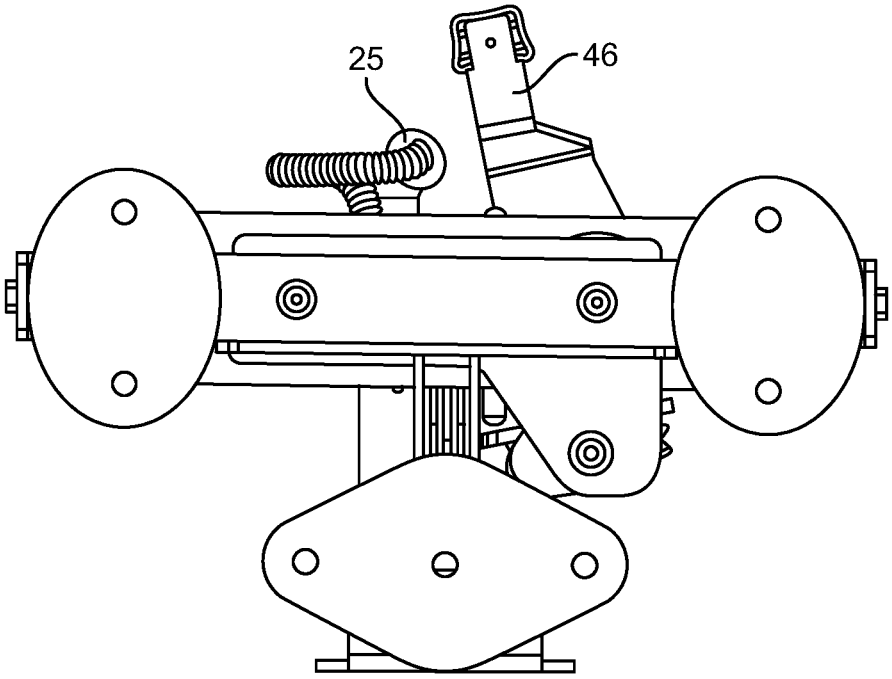
FIG. 5 is a bottom plan view of the present system.
Figure 6A:
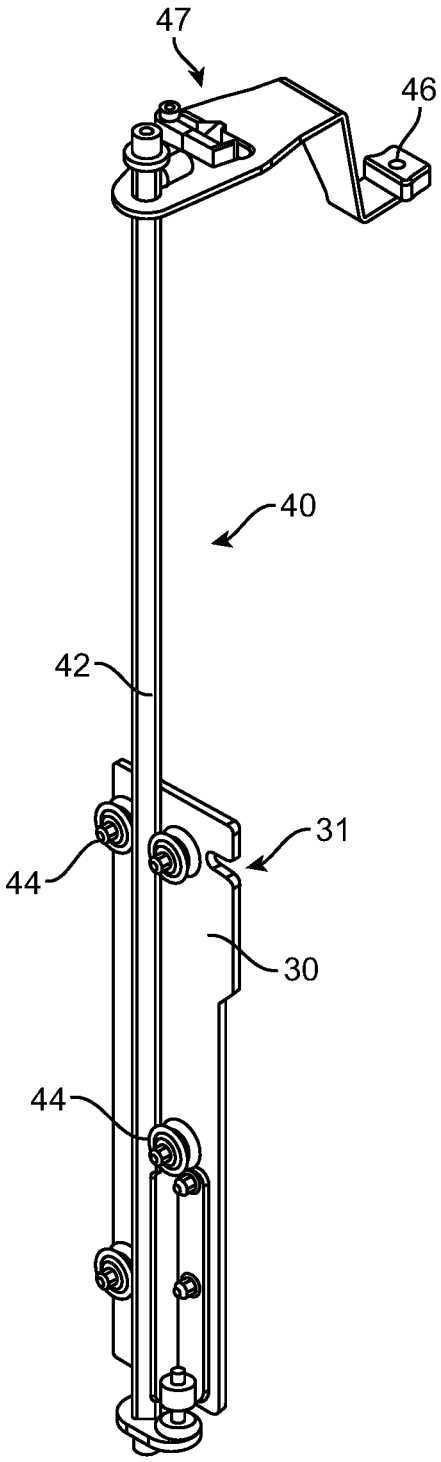
FIG. 6A is a perspective view of the add-on weight selection mechanism.
Figure 6B:
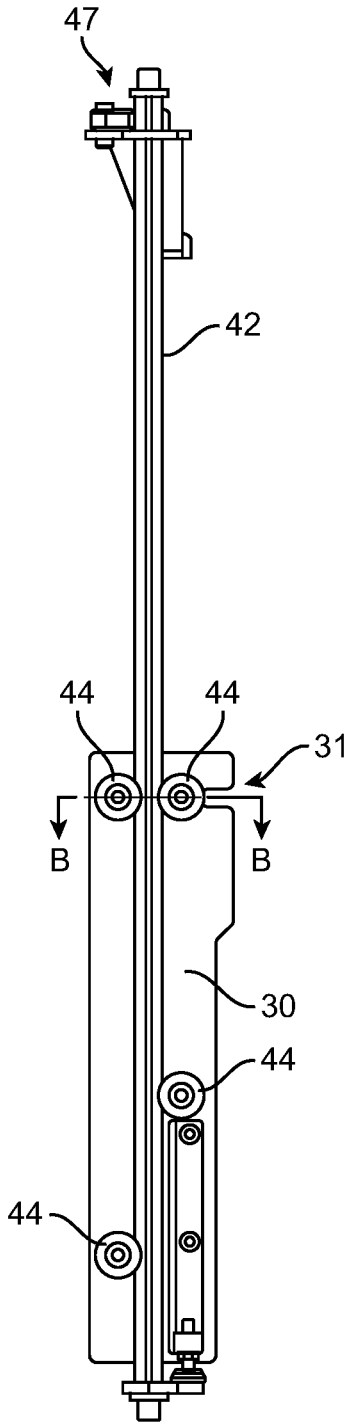
FIG. 6B is a front view of the add-on weight selection mechanism.
Figure 6C:
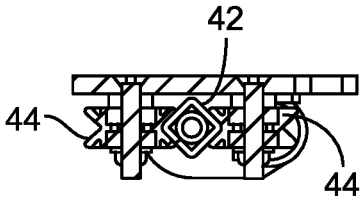
FIG. 6C is a sectional view taken along line B-B in FIG. 6B.
Figure 7:
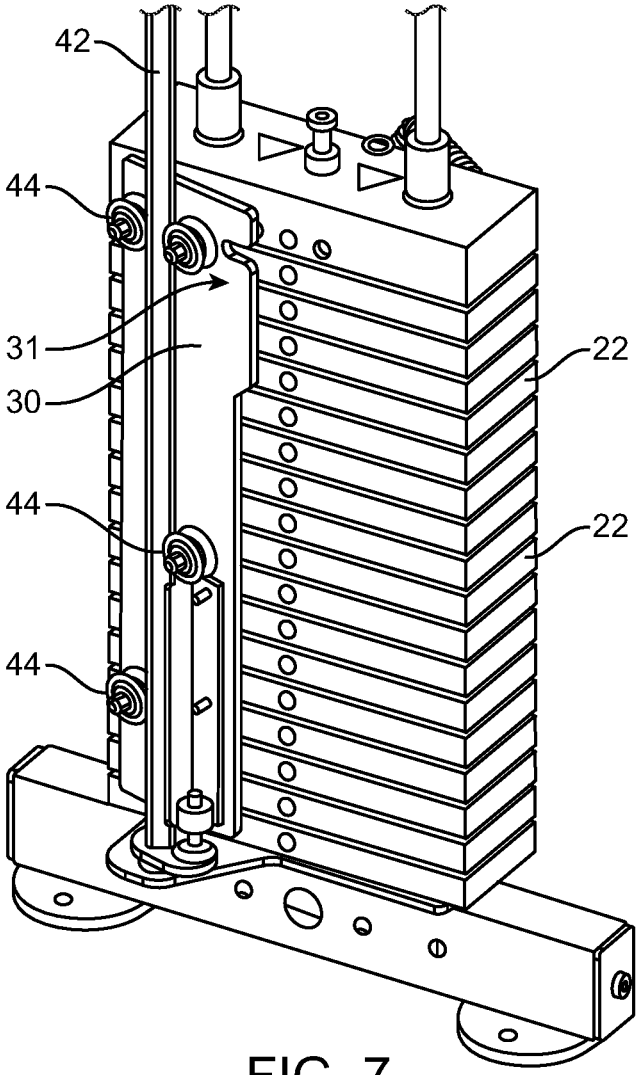
FIG. 7 is a perspective view of the back bottom of the weight stack with the add-on weight panel in the disengaged position.
Figure 8:
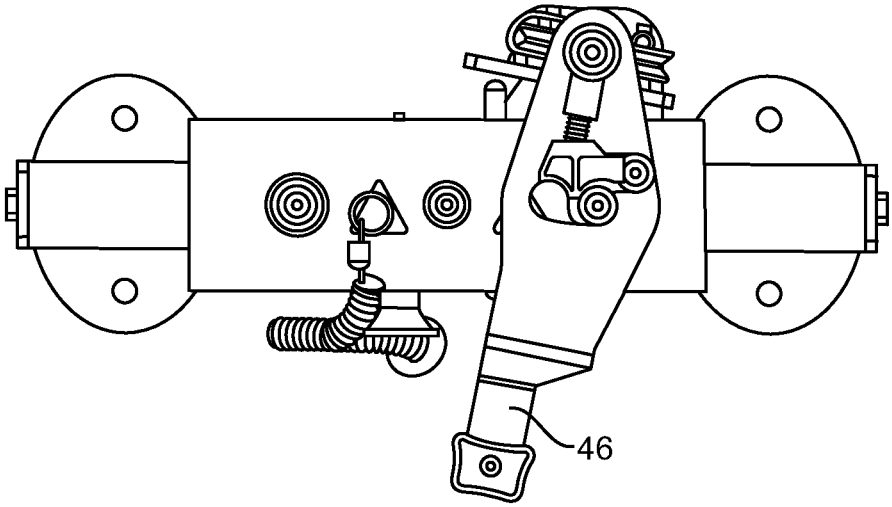
FIG. 8 is a top plan view corresponding to FIG. 7, with the add-on weight panel in the disengaged position.
Figure 9:
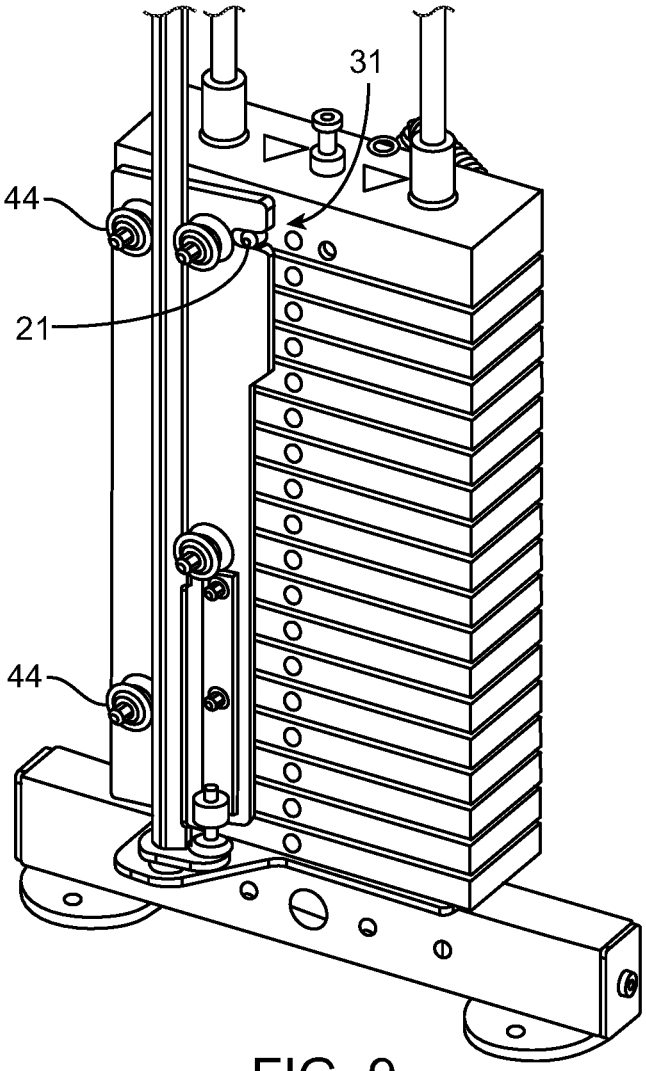
FIG. 9 is a perspective view of the back bottom of the weight stack with the add-on weight panel in the engaged position.
Figure 10:
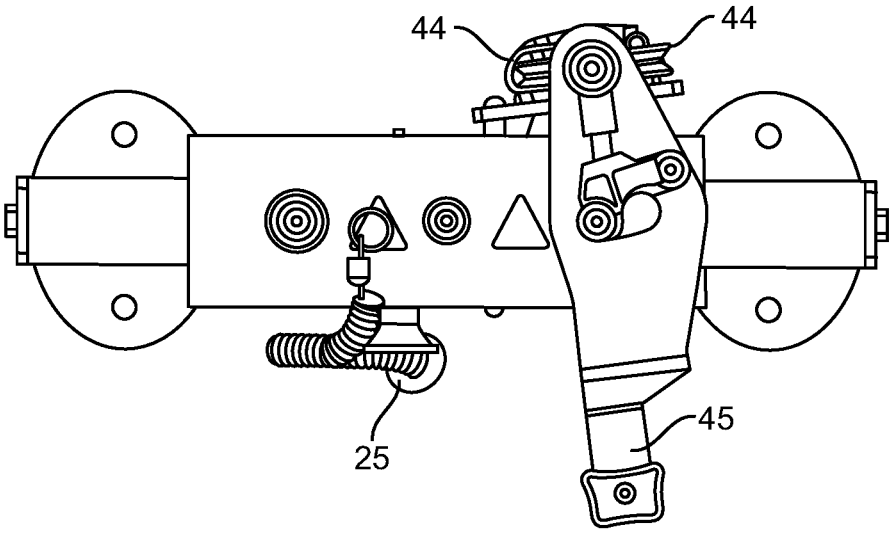
FIG. 10 is a top plan view corresponding to FIG. 9, with the add-on weight panel in the engaged position.
Figure 11:
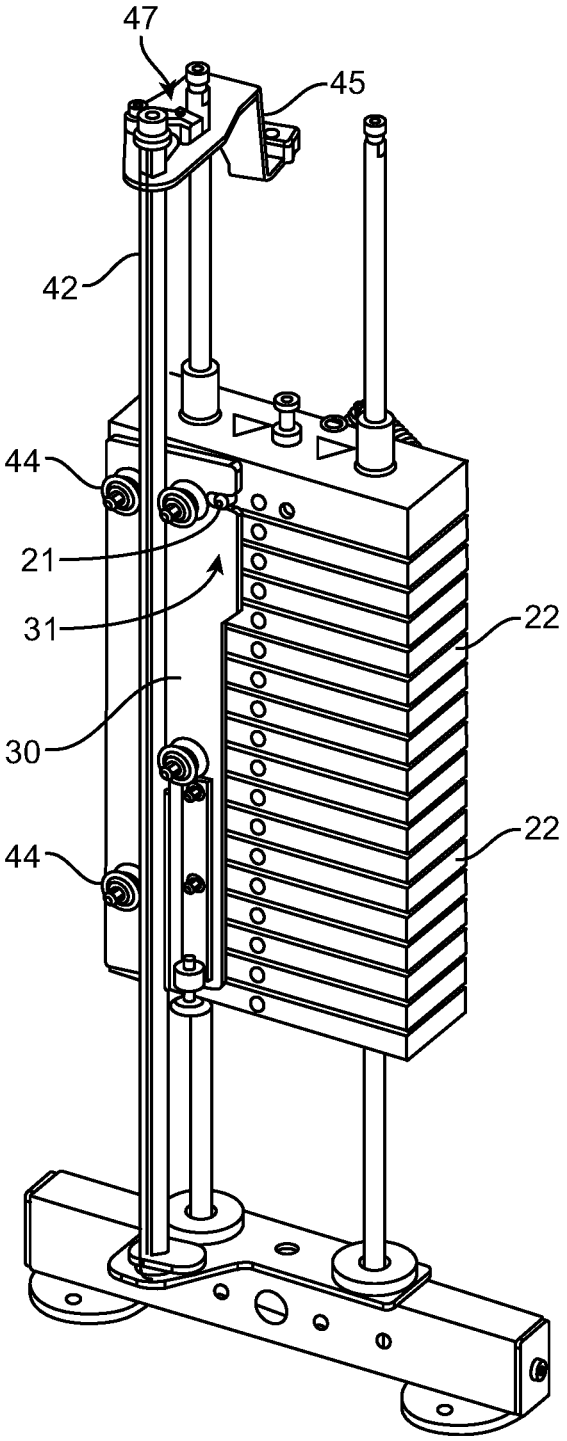
FIG. 11 is a rear perspective view of the add-on weight panel engaged with the weight stack and being lifted together with the weight stack.
Figure 12A:
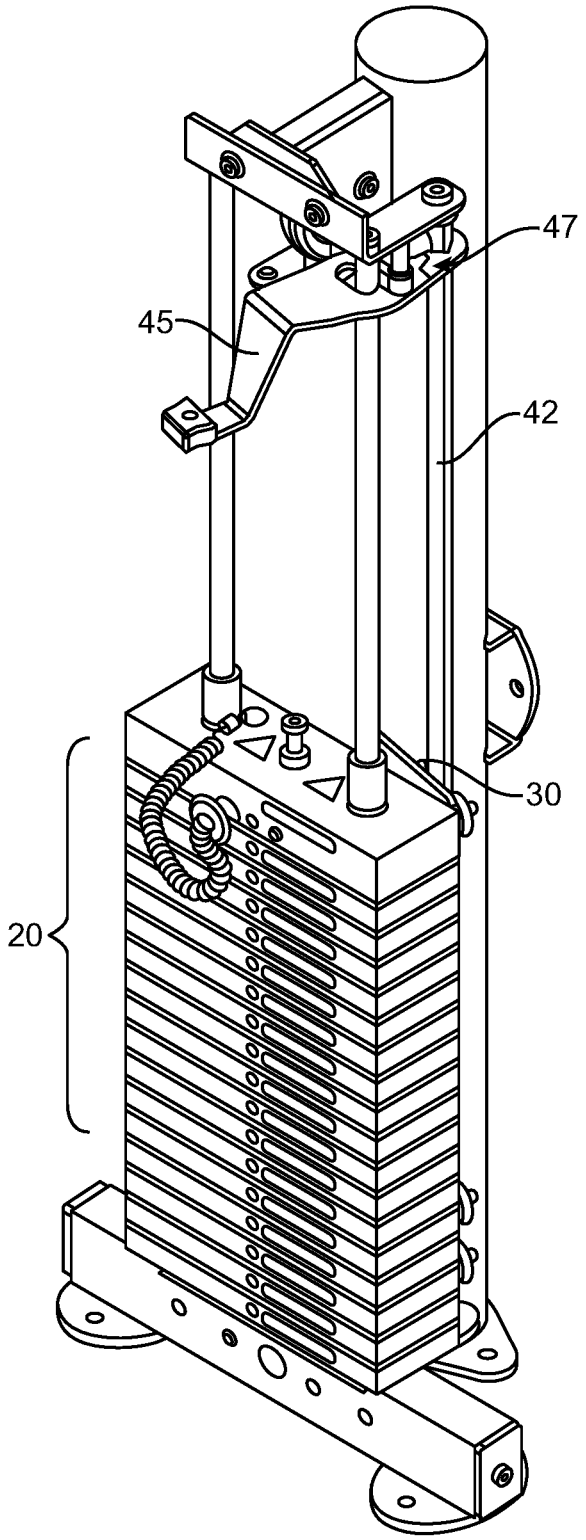
FIG. 12A is a front perspective view of the weight stack with the weight panel in an engaged position.
Figure 12B:
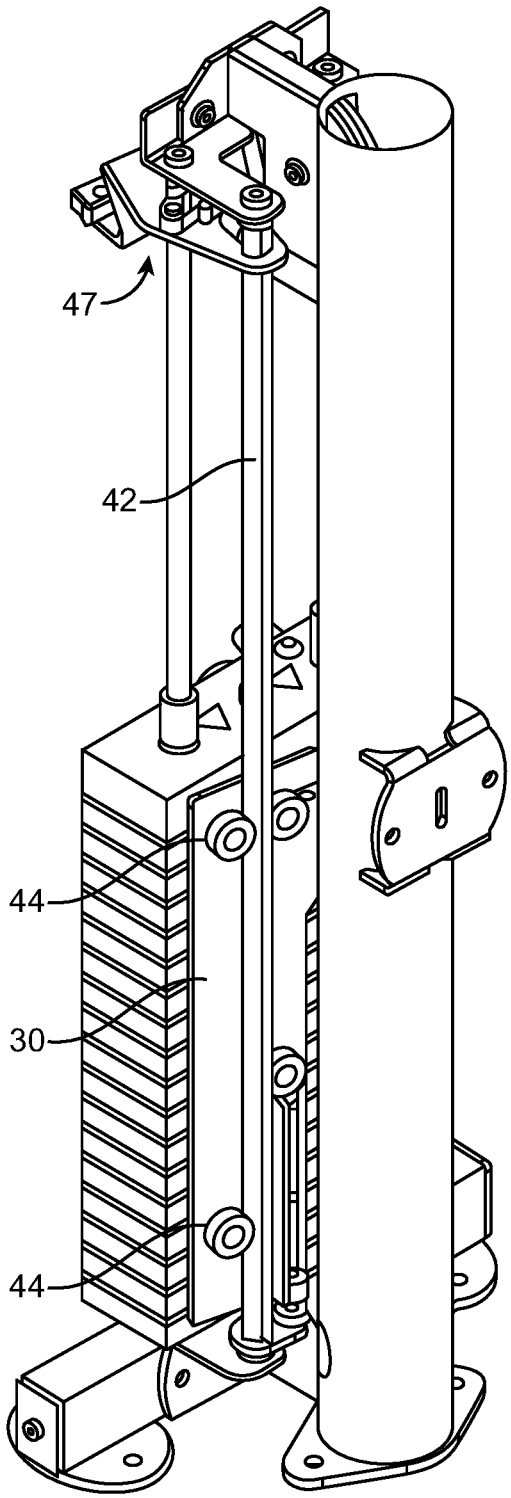
FIG. 12B is a rear perspective view corresponding to FIG. 12A.

As seen in the attached Figures, the present system provides an add-on weight system 10 for a cable exercise machine. Add-on weight system 10 preferably comprises:

(a) a weight stack 20 comprising a plurality of stacked weight plates 22;

(b) a weight selector 25 for selecting a number of the plurality of stacked weight plates 22 to be lifted;

(c) an add-on weight panel 30 configured to be lifted together with a selected number of the plurality of stacked weight plates 22; and (d) an add-on weight selection mechanism 40 for moving the add-on weight panel 30 between:

an engaged position (as seen in FIG. 9) such that the add-on weight panel 30 engages with the weight plates 22 to be lifted and is lifted together with the selected weight plates (as seen in FIG. 11), and a disengaged position (as seen in FIG. 7) such that the add-on weight panel 30 disengages with the weight plates 22 to be lifted and is not lifted together with the selected weight plates.

As best seen in FIGS. 9 and 11, the weight stack 20 preferably includes a projection 21 extending from a weight plate at the top of the weight stack, and the add-on weight panel 30 has a notch 31 dimensioned to receive projection 21 therein.

In operation, the add-on weight selection mechanism 40 rotates the add-on weight panel 30 about a vertical axis between the engaged position (as seen in FIG. 9) and the disengaged position (as seen in FIG. 7). Most preferably, the add-on weight selection mechanism 40 comprises:

a vertical pole 42, and a plurality of rollers 44 connected to the add-on weight panel 30. The rollers 44 are positioned to travel along the vertical pole 42 as the add-on weight panel 30 is raised and lowered.

Also in preferred aspects, a hand lever 46 connected to the vertical pole 42 is used for moving the add-on weight panel 30 about the vertical axis passing through the vertical pole 42. In optional preferred aspects, hand lever 46 is biased into the engaged position or the disengaged position. This may be done by using a spring-loaded follower 47.

As best seen in FIGS. 7 and 11, the add-on weight panel 30 may be a long slender object that is preferably conveniently positioned out of the way behind weight stack 30. In optional embodiments, the add-on weight panel 30 may have a height approximately equal to the height of the weight stack 20 as best shown in FIG. 7.

Preferably, the add-on weight panel 30 weighs less than any one of the weights 22 in weight stack 20. Most preferably, the add-on weight panel 30 weight is ½ of the weight of each of the weights 20 in the weight stack. For example, if each weight 22 in weight stack 20 weighs 10 lbs, then add-on weight panel 30 could weigh 5 lbs. As such, should a user wish to lift 30 lbs, (s)he would use pin 25 to select three weight panels 22. However, should (s)he instead wish to lift 35 lbs, (s)he would use pin 25 to select three weight panels 22 and also use lever arm 46 to rotate add-on weight panel 30 into its engaged position such that it (weighing 5 lbs) is lifted together with the three weight panels (each weighing 10 lbs), thereby lifting a total of 35 lbs. As can be seen, weight selector 25 may simply be a pin and each of the weights 22 in weight stack 20 have a hole to receive pin 25 therein.

What is claimed is:

1. An add-on weight selection system for an exercise machine, comprising:

(a) a weight stack comprising a plurality of stacked weight plates;

(b) a weight selector for selecting a number of the plurality of stacked weight plates to be lifted;

(c) an add-on weight panel configured to be lifted together with a selected number of the plurality of stacked weight plates; and (d) an add-on weight selection mechanism for moving the add-on weight panel between:

an engaged position such that the add-on weight panel engages with the weight plates to be lifted and is lifted together with the selected weight plates, and a disengaged position such that the add-on weight panel disengages with the weight plates to be lifted and is not lifted together with the selected weight plates, wherein the add-on weight selection mechanism comprises a rotatable hand lever that is positioned at a top end of the exercise machine, and wherein the rotatable hand lever does not move up or down as the add-on weight panel moves up and down.

2. The system of claim 1, wherein the add-on weight selection mechanism for moving the add-on weight panel rotates the add-on weight panel about a vertical axis between the engaged position and the disengaged position.

3. The system of claim 2, wherein the add-on weight selection mechanism comprises:

a vertical pole, and a plurality of rollers connected to the add-on weight panel, wherein the rollers are positioned to travel along the vertical pole as the add-on weight panel is raised and lowered.

4. The system of claim 3, wherein the add-on weight selection mechanism rotates the add-on weight panel about the vertical pole from the engaged position to the disengaged position.

5. The system of claim 4, wherein the hand lever is connected to the vertical pole.

6. The system of claim 5, wherein the hand lever is biased into the engaged position or the disengaged position.

7. The system of claim 2, wherein the add-on weight panel weighs less than any one of the weights in the weight stack.

8. The system of claim 7, wherein the add-on weight panel weighs one-half of the weight of each of the weights in the weight stack.

9. The system of claim 1, wherein the weight stack includes a projection extending from a weight plate at the top of the weight stack, and wherein the add-on weight panel has a notch dimensioned to receive the projection therein.

10. The system of claim 1, wherein the add-on weight panel is positioned behind the weight stack.

11. The system of claim 1, wherein the add-on weight panel has a height approximately equal to the height of the weight stack.

12. The system of claim 1, wherein the weight selector is a pin and each of the weights in the weight stack has a hole to receive the pin therein.

* * * * *